US010027077B2

(12) United States Patent
Niedermeier et al.

(10) Patent No.: US 10,027,077 B2
(45) Date of Patent: Jul. 17, 2018

(54) CONTACT POINT FOR CONNECTING A FLAT CONDUCTOR TO A CONDUCTOR ELEMENT

(71) Applicant: Lisa Draexlmaier GmbH, Vilsbiburg (DE)

(72) Inventors: Benedikt Niedermeier, Niederaichbach (DE); Wolfgang Wimmer, Salching (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 15/432,349

(22) Filed: Feb. 14, 2017

(65) Prior Publication Data

US 2017/0250510 A1 Aug. 31, 2017

(30) Foreign Application Priority Data

Feb. 26, 2016 (DE) ..... 10 2016 103 439

(51) Int. Cl.
*H01R 4/24* (2018.01)
*H01R 25/14* (2006.01)
(Continued)

(52) U.S. Cl.
CPC ..... *H01R 25/142* (2013.01); *H01R 13/506* (2013.01); *H01R 13/5221* (2013.01); *H01R 13/68* (2013.01)

(58) Field of Classification Search
CPC .. H01R 4/2429; H01R 4/2433; H01R 9/0757; H01R 4/2404; H01R 9/0771; H01R 4/34
(Continued)

(56) References Cited

U.S. PATENT DOCUMENTS 5,645,448 A 7/1997 Hill
5,691,506 A * 11/1997 Miyazaki ..... H01R 4/646 174/652
(Continued)

FOREIGN PATENT DOCUMENTS

DE 601 10 509 T2 1/2006
DE 10 2007 034 394 A1 4/2008
(Continued)

OTHER PUBLICATIONS

Office Action in German Application No. DE 10 2016 103 439 8, dated Dec. 1, 2016.

*Primary Examiner* — Phuong Chi T Nguyen
(74) *Attorney, Agent, or Firm* — Finnegan, Henderson, Farabow, Garrett & Dunner LLP

(57) ABSTRACT

A contact point for establishing a connection to a conductor element according to the present disclosure comprises a flat conductor having first and second ends, and a contact element connected to the flat conductor in a terminal area of the flat conductor, wherein the contact element is also configured to connect to the conductor element. The contact point comprises a multi-shell housing attached to the flat conductor and configured to cover the contact element and the terminal area. The housing comprises at least three openings, wherein first and second openings enable passage of first and second ends of the flat conductor, and a third opening enables passage of the conductor element. A gasket is attached to at least one of the openings for sealing the housing.

19 Claims, 2 Drawing Sheets

(51) Int. Cl.
*H01R 13/52* (2006.01)
*H01R 13/506* (2006.01)
*H01R 13/68* (2011.01)

(58) Field of Classification Search
USPC ..... 439/395, 404, 405, 419, 422, 217
See application file for complete search history.

(56) References Cited

U.S. PATENT DOCUMENTS

| | | | | |
|---|---|---|---|---|
| 6,030,257 | A | 2/2000 | Furuya | |
| 6,616,475 | B2 * | 9/2003 | Nagai ..... | H01R 4/18 439/217 |
| 2002/0028597 | A1 | 3/2002 | Nagai | |
| 2008/0083547 | A1 | 4/2008 | Pinol Pedret et al. | |
| 2015/0325340 | A1 | 11/2015 | Specht et al. | |

FOREIGN PATENT DOCUMENTS

| | | | |
|---|---|---|---|
| DE | 10 2012 214 161 | A1 | 2/2014 |
| DE | 10 2012 217 618 | A1 | 3/2014 |
| DE | 10 2014 004 432 | A1 | 10/2014 |
| DE | 10 2014 004 433 | A1 | 10/2014 |
| DE | 10 2014 004 430 | A1 | 10/2015 |
| DE | 10 2014 004 431 | A1 | 10/2015 |

* cited by examiner

CONTACT POINT FOR CONNECTING A FLAT CONDUCTOR TO A CONDUCTOR ELEMENT

CROSS REFERENCE TO RELATED APPLICATIONS

This application is based upon and claims the benefit of prior German Patent Application No. 10 2016 103 439.8, filed on Feb. 26, 2016, the entire contents of which are incorporated herein by reference.

TECHNICAL FIELD

The present disclosure relates to a contact point for a flat conductor, for establishing and sealing an electrical connection to the flat conductor. The present disclosure can be used in on-board electrical applications in automotive engineering.

BACKGROUND

German patent documents DE 102012214161 A1, DE 102014004432 A1, and DE 102014004433 A1 disclose methods for connecting electrical conductors and contact elements, for instance when the contact elements are paired with flat conductors. For an effective electrical connection the insulation is generally removed from both the conductor and the contact element to permit them to be interconnected, for instance by welding.

German patent documents DE 102014004431 A1 and DE 102014004430 A1 disclose extrusion with a self-adhesive polypropylene for sealing the exposed transitional areas between the conductor and the contact element. In these cases, however, the different flat conductors and contact elements are not provided with a uniform insulating material for which a compatible material can be selected for the extrusion. Alternatively, German patent document DE 102012217618 A1 discloses casting around a flat conductor.

German patent document DE 102015222582 A1 discloses a seal using a sleeve-shaped adapter and then overmolding the connection.

U.S. Pat. No. 5,645,448 A discloses a connector for a battery module in which a flip-open housing covers the screws connecting the contact elements of attached conductors to the battery terminal, and a fuse. U.S. Pat. No. 6,030,257 A discloses a fuse arranged between a busbar and a contact element of a conductor that is fixed in place by a screw connection. This connection is encased in a housing.

German patent document DE 601 10 509 T2 discloses a connecting configuration of electric wires in a lamp unit in which a flat cable (FFC flexible flat cable) comprised of several round conductors is connected to a busbar for each round conductor. This connecting configuration is supported on a surrounding housing. German patent document DE 10 2007 034 394 A1 discloses a sealed junction box.

SUMMARY

Embodiments of the present disclosure provide a contact point for a flat conductor that is detachable and ensures a good seal.

Embodiments of the present disclosure provide a contact point for a flat conductor. The contact point includes a contact element connected to the flat conductor in a terminal area of the flat conductor. The contact point may also include a conductor that is adapted for connection to the contact element. A multi-shell housing covers the contact element and the terminal area of the flat conductor, and the housing is attached to the flat conductor. This may provide greater functionality to the contact point while requiring less space. Embodiments provide a detachable and well-sealed connection that has fewer components and lower production costs.

Embodiments of the present disclosure provide a housing with at least three openings (for example, two openings for guiding the flat conductors and one opening for guiding a conductor) with at least a portion of the openings or all openings being equipped with a gasket to improve the seal of the contact point. The housing may be made of a fiberglass-reinforced polyamide, for example. The flat conductor is guided through the housing, which makes the housing self-supporting on the flat conductor. In some embodiments, two or more conductors and their fuse protection may be integrated into the contact point. The number of openings may then increase accordingly.

According to embodiments of the present disclosure, the housing may be attached in a self-supporting manner, i.e. it does not require support by other components of an on-board network of a vehicle. Instead, the housing braces itself against the flat conductor by encasing the conductor. In some embodiments, the housing consists of at least two interconnectable shells. A firm hold and protection for the contact point are created when the shells of the housing are placed around the flat conductor (for example, at least in the terminal area) and around the contact element, and the shells are then connected together.

According to embodiments of the present disclosure, the shells may overlap after being attached, so that no moisture can penetrate the gap between the shells. The upper shell may be placed over the lower shell for this purpose. The shells may be joined together by a latch connection. An adequate number of latch connections firmly holds the housing to the flat conductor. For example, two or more may be arranged on each side of the flat conductor and/or contact element.

According to embodiments of the present disclosure, a flat conductor may measure 20 to 100 mm in width and 1 to 5 mm in height. For automotive applications dimensions of 30 to 60 mm in width and 1 to 2 mm in height may be used in the design of the central on-board network. Thus, the flat conductor may be larger than the conductor or the contact element.

According to embodiments of the present disclosure, the functionality of the contact point may be enhanced if the contact element and the conductor are interconnected via a fuse, in which case the housing also covers the fuse. Fuse protection may be established for the individual line. Additionally, the fuse can be covered and sealed by the same housing. If in addition the fuse is detachably joined to the contact element and the conductor, screw connections may be used, as the fuse can then be replaced after it has been triggered.

According to embodiments of the present disclosure, the housing has female profiles on the inside to snugly accommodate the fuse. The profiles in this case may match the shape of the fuse and/or its mount, for example in that cavities corresponding in shape to the screw heads or the nuts are provided in the housing for the screw connections. The fuse may be aligned therein.

According to embodiments of the present disclosure, the seal is affixed in a two component (2C) injection molding process, i.e. when the housing is produced by injection molding a gasket is made at the same time from a second material such as a thermoplastic elastomer (TPE), ethylene-propylene-diene monomer (EPDM—rubber) or silicone, which enables it to closely hug the insulation of the flat conductor and/or the conductor. If the gasket also comprises two "U-shaped" sealing rings, the seal can further include several overlapping sealing zones.

According to embodiments of the present disclosure, the housing has at least one dehumidifying port, particularly near a fuse. Residual humidity can escape through this port.

According to embodiments of the present disclosure, the housing includes a drip rim on the outer contour of the upper shell, which is downwardly directed when installed. Water drip-off or splashes that possibly strike the housing may run off the side walls and drip off at the drip rim without penetrating into the gap between the housing shells due to adhesive forces.

According to embodiments of the present disclosure, a contact element may be mounted on a narrow side of a substantially rectangular flat conductor and the fuse may be aligned parallel to the flat conductor to maintain a small installed space. For this purpose, the contact element may be perpendicular to the narrow side of the flat conductor and the fuse may be attached to the contact element so as to again be parallel to the flat conductor. The flat conductor itself may be made from a soft-annealed aluminum and is enveloped in a layer of insulation, as is the conductor.

Embodiments of the present disclosure provide a contact point for establishing a connection to a conductor element. The contact point comprises a flat conductor having first and second ends and a terminal area, a contact element connected to the flat conductor in the terminal area of the flat conductor, wherein the contact element is also configured to connect to the contact element, a housing attached to the flat conductor and configured to cover the contact element and the terminal area, the housing comprising a first opening enabling passage of the first end of the flat conductor, a second opening enabling passage of the second end of the flat conductor, and a third opening enabling passage of the conductor element, and a gasket attached to at least one of the openings for sealing the housing.

The described properties of the present disclosure and the manner in which these are achieved will be described in more detail based on the following detailed description. The foregoing general description and the following detailed description are exemplary and explanatory only, and are not restrictive of embodiments consistent with the present disclosure. Further, the accompanying drawings illustrate embodiments of the present disclosure, and together with the description, serve to explain principles of the present disclosure.

DETAILED DESCRIPTION

Figure 1:
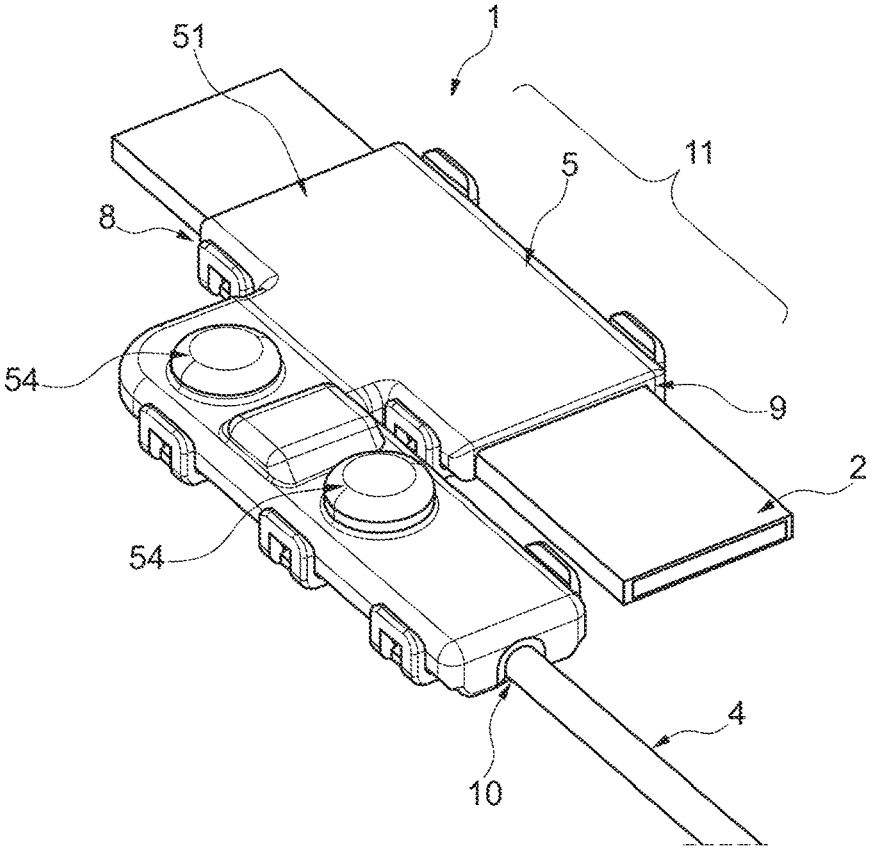
FIG. 1 shows a plan view of an exemplary contact point with a closed housing.

FIG. 1 shows a contact point 1 according to the present disclosure after all individual parts have been mounted to create a fuse-protected single-conductor connection from a flat conductor 2. A section of a rectangular flat conductor 2 made of, for example, aluminum is shown in a terminal area 11. For example, one such flat conductor may measure 30×2 mm and be insulated with polypropylene (PP) or polyvinyl chloride (PVC) approximately 1 mm thick. This flat conductor 2 is to be connected to a conductor 4, such as a round stranded conductor of copper or aluminum with insulation of PP or PVC.

The connection is made inside a housing 5 comprising two interconnected shells 51, 52 that cover the contact point 1. The interconnected shells may comprise an upper shell 51 and a lower shell 52. As shown in FIG. 1, this housing 5 has three openings. Two openings 8, 9 enable passage of the flat conductor 2, and one opening 10 enables passage of the conductor 4. Female profiles 54 shown in the housing 5 accommodate a fuse 6 (shown in FIG. 2) on the inner side 53 of the housing 5, as explained in further detail below.

Figure 2:
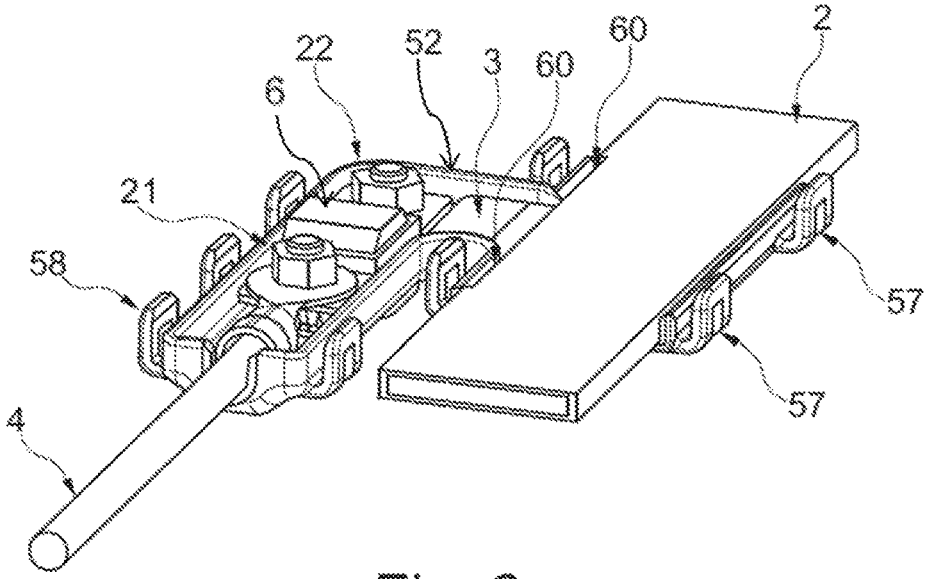
FIG. 2 shows a plan view of an exemplary contact point with an open housing.

Additional details of the contact point 1 of the present disclosure are shown in FIG. 2. FIG. 2 shows housing 5 with an upper shell 51 removed. A lower shell 52 of the housing accommodates the flat conductor 2. Detent lugs 60, oriented toward the middle of the flat conductor 2, and an insertion guide with an inclination descending toward the middle of the flat conductor 2, are located on the walls of the lower shell 52 that correspond to the narrow sides of the flat conductor 2. This may enable the flat conductor 2 to be inserted and latched to the lower shell 52 before the upper shell 51 is attached.

A cladded contact element 3 is affixed to the flat conductor 2. The contact element may be made of copper or aluminum, for example. The contact element 3 is stamped from a roll-cladded blank with a copper/aluminum transition. After the stamping step, both the area to be affixed to a fuse 6 and the aluminum/copper transition are coated. The coating may be nickel and tin or tin and silver. The aluminum/copper transition may also be protected from electrochemical corrosion or electrolytes by varnishing, overmolding or other coating processes. The partially coated, cladded contact element 3 is welded with a laser at an uncoated aluminum side to a terminal part (that may be made of aluminum) of the flat conductor 2. This may yield an aluminum-to-aluminum connection with good conductive properties. The cladded, coated aluminum/copper transition is not damaged by the welding process.

The contact element 3 has an opening into which a screw may be inserted, such that a fuse 6 may be connected to the contact element 3 by a detachable screw connection 22. The terminal part and the contact element 3 are perpendicular to the narrow side of the flat conductor 2 and the fuse 6 is further turned by the screw connection 22 by 90° relative to the contact element 3. Accordingly, the fuse 6 is substantially parallel to the flat conductor 2. However, it is also contemplated to orient the fuse and the line exit perpendicular to the flat conductor 2.

The fuse 6 is connected to the conductor 4 on a side facing away from the contact element 3. The conductor 4 ends with a contact element that is crimped or welded to the conductor 4. This contact element has an opening that aligns with another opening of the fuse 6. Thus the fuse 6 and the contact element of the conductor 4 may be connected by an additional screw connection 21. The fuse 6 is thus detachably affixed to the conductor 4 and the contact element 3, thereby facilitating easier replacement of the fuse 6 after it has been triggered.

Figure 4:
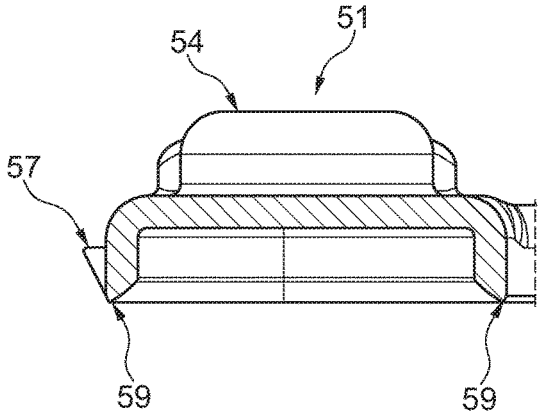
FIG. 4 shows a side view of the upper shell of an exemplary housing.

The lower shell 52 also serves as a support for the fuse 6, the screw connections 21, 22 and the contact element 3. The housing 5 covers the entire contact point 1 and is approximately L-shaped, or T-shaped if the fuse 6 is perpendicularly oriented. The housing 5 in total may therefore measure approximately 60×80 mm with a height of approximately 10 mm. The lower shell 52 has a plurality of latch connections 57, 58. As shown in FIG. 2, the lower shell may have two latches 57, 58 on both sides of the flat conductor and one or three latches 57, 58 on the respective sides of the fuse 6. The latches 57, 58 each consist of a bracket projecting from the lower shell 52 and pointing up from below toward the upper shell. A detent lug of the latches 57, 58 of the upper shell 51 engages in the center of the bracket, as shown in FIG. 4. This structure of the latches 57, 58, in which the upper shell 51 moves between the bracket and the side wall of the lower shell 52, prevents the penetration of moisture into the housing 5 caused by splashes or drops of water.

Figure 3:
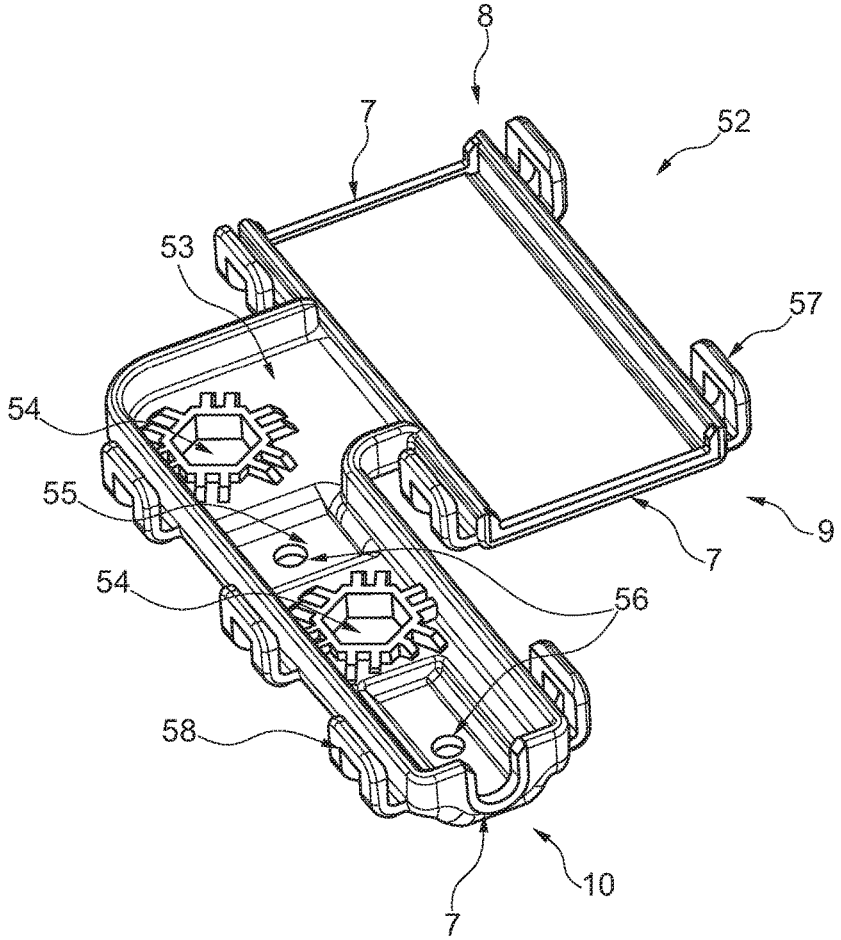
FIG. 3 shows a plan view of the lower shell of an exemplary housing.

The housing 5 exhibits additional properties for sealing the contact point 1, as further explained below. FIG. 3 shows the lower shell 52 of the housing 5 without the inserted flat conductor 2, fuse 6 and conductor 4. Dehumidifying ports 56 are visible at the lowest points of the shell 52, between the screw connections 21, 22 and underneath the crimp for the conductor 4. Any penetrating moisture can escape through the dehumidifying ports 56.

Gaskets 7 are provided at the openings 8, 9, 10 at which the flat conductor 2 and/or the conductor 4 exit the housing. Similar types of gaskets 7 (not shown) are also provided on the upper shell 51. The gaskets 7 may be produced together with the housing 5 by 2C injection molding. The material of the housing 5 differs from that of the gasket 7. For example, the housing 5 may be made of fiberglass-reinforced polyamide, while the gasket may be made of a thermoplastic elastomer (TPE) or ethylene propylene diene rubber (EPDM).

Figure 5:
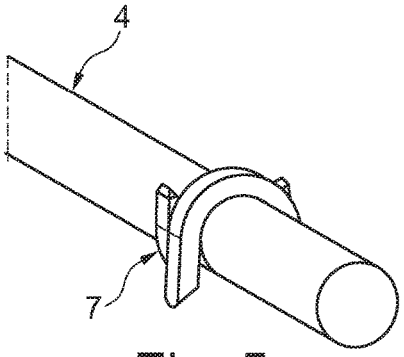
FIG. 5 shows an exemplary sealing element on the conductor.

FIG. 5 illustrates the sealing action. The gasket 7 for the conductor 4 is shown as an example. The gaskets 7 for the two shells 51, 52 are U-shaped. When the upper shell is fitted onto the lower shell the ends of the gaskets overlap considerably. Furthermore, the gaskets 7 are arranged adjacent to and touching one another along the longitudinal expanse of the conductor 4. The upper shell 52 along the flat conductor 2 is also slightly longer than the lower shell 51.

A further sealing measure is seen in FIG. 4, which shows a cross-section of the upper shell 51. The shell 51 includes the female profile 54 for a screw head. In addition, a detent lug of the latch 57, for interaction with the bracket of the lower shell 52, and drip rims 59 are provided on the side walls of the shell 51. The drip rims 59 are located on the lower end of the side wall and taper outwardly to a point. Any moisture running off the outside of the upper shell 51 would collect and drip off at the particular drip rim 59 instead of being drawn by capillary forces into the gap between the shells 51, 52.

The contact point 1 of the present disclosure has been explained on the basis of a single-layer flat conductor. However, the contact point could also be embodied for multi-layer flat conductors. For example, a uniform housing 5 may be used for terminals of any of the several layers of a flat conductor, and the contact element 3 may be in centric alignment with the flat conductor 2. Moreover, the particular terminal part would compensate the difference in height. Thus, the terminal part may be perpendicular to the narrow side of the flat conductor 2 and may also have a bent or inclined section to enable it to reach the vertical center of the flat conductor and the contact element 3. The bend or incline, however, should be arranged outside of the aluminum/copper transition.

In some embodiments, it is also contemplated to use the flat conductor shown in FIGS. 1-5 for every layer of the multi-layer flat conductor, if a cavity for a shell 51, 52 of the housing 5 is provided between the layers in the terminal area 11 of the flat conductor. For example, this could be done by partially spacing the layers apart in the terminal area 11.

The drawings merely depict schematic representations and serve only to illustrate the present disclosure. The same or similar elements are provided throughout with the same reference numbers.

Having described aspects of the present disclosure in detail, it will be apparent that modifications and variations are possible without departing from the scope of aspects of the present disclosure as defined in the appended claims. As various changes could be made in the above constructions, products, and methods without departing from the scope of aspects of the present disclosure, it is intended that all matter contained in the above description and shown in the accompanying drawings shall be interpreted as illustrative and not in a limiting sense.

LIST OF REFERENCE NUMBERS contact point 1
flat conductor 2
contact element 3
conductor 4
housing 5
fuse 6
gasket 7
openings 8, 9, 10
terminal area 11
screw connections 21, 22
shells 51, 52
inner side 53
female profiles 54, 55
dehumidifying port 56
latch 57, 58
drip rim 59
detent lugs 60

What is claimed is:

1. A contact point assembly for establishing a connection to a conductor element, the contact point assembly comprising:

a substantially-rectangular flat conductor formed of solid conductive material and having first and second ends, a flat lateral side extending along a length of the substantially-rectangular flat conductor, and a terminal area;

a contact element connected to the flat lateral side of the flat conductor in the terminal area of the flat conductor, wherein the contact element is also configured to connect to the conductor element;

a housing attached to the flat conductor and configured to cover the contact element and the terminal area, the housing comprising:

a first opening enabling passage of the first end of the flat conductor;

a second opening enabling passage of the second end of the flat conductor; and a third opening enabling passage of the conductor element;

a gasket attached to at least one of the openings for sealing the housing; and a fuse connecting the contact element and the conductor element, wherein the housing is configured to cover the fuse.

2. The contact point assembly according to claim 1, wherein the flat conductor is enveloped in a layer of insulation.

3. The contact point assembly according to claim 1, wherein the housing comprises a dehumidifying port in the area of the fuse.

4. The contact point assembly according to claim 1, wherein the housing comprises a drip rim directed downwardly when installed.

5. The contact point assembly according to claim 1, wherein the fuse is detachably connected to the contact element and the conductor element.

6. The contact point assembly according to claim 5, wherein the fuse is detachably connected via screw connections.

7. The contact point assembly according to claim 6, wherein the housing comprises female profiles on an inner side, the female profiles configured to align at least one of the fuse or the screw connections.

8. The contact point assembly according to claim 7, wherein the gasket is produced with the housing in a two-component injection molding process.

9. The contact point assembly according to claim 1, wherein the housing is a multi-shell housing comprising at least two interconnectable shells.

10. The contact point assembly according to claim 9, wherein the shells at least partially overlap when interconnected.

11. The contact point assembly according to claim 9, wherein the shells are interconnected by a latch connection.

12. The contact point assembly according to claim 9, wherein the shells are interconnected by a plurality of latch connections on respective sides of at least one of the flat conductor or the contact element.

13. A contact point assembly for establishing an electrical connection to a conductor element, the contact point assembly comprising:

a flat conductor having first and second ends;

a contact element connected to the flat conductor in a terminal area of the flat conductor;

a fuse connecting the contact element and the conductor element;

a multi-shell housing attached to the flat conductor and configured to cover the contact element, the terminal area, the fuse, and at least a portion of the conductor element, the housing comprising:

a first opening enabling passage of the first end of the flat conductor at the terminal area;

a second opening enabling passage of the second end of the flat conductor at the terminal area; and a third opening enabling passage of the conductor; and a gasket attached to at least one of the openings for sealing the multi-shell housing.

14. The contact point assembly according to claim 13, wherein the housing comprises fiberglass-reinforced polyamide, and the gasket comprises thermoplastic elastomer (TPE) or ethylene propylene diene rubber (EPDM).

15. The contact point assembly according to claim 13, wherein the housing comprises a dehumidifying port in the area of the fuse.

16. The contact point assembly according to claim 13, wherein the housing comprises an upper shell and a lower shell, the shells at least partially overlapping when interconnected.

17. The contact point assembly according to claim 16, wherein the shells are interconnected by a plurality of latch connections on respective sides of at least one of the flat conductor or the contact element.

18. The contact point assembly according to claim 16, wherein the gasket is attached to the third opening, the gasket comprising two U-shaped sealing rings configured to provide overlapping sealing zones.

19. The contact point assembly according to claim 18, wherein a first of the two U-shaped sealing rings is attached to the upper shell and a second of the two U-shaped sealing rings is attached to the lower shell.

* * * * *